United States Patent [19]

Weinstein

[11] 4,444,795

[45] Apr. 24, 1984

[54] FROZEN CONFECTION AND PACKAGING MODULE

[75] Inventor: David Weinstein, Baltimore, Md.

[73] Assignee: Maryland Cup Corporation, Owings Mills, Md.

[21] Appl. No.: 462,188

[22] Filed: Jan. 31, 1983

Related U.S. Application Data

[63] Continuation of Ser. No. 246,180, Mar. 23, 1981, abandoned.

[51] Int. Cl.[3] ..... B65D 85/78

[52] U.S. Cl. ..... 426/90; 206/606; 206/627; 206/822; 426/95; 426/115; 426/122; 426/123; 426/106; 426/130; 229/43; 229/87 F; 229/1.5 B

[58] Field of Search ..... 426/132, 139, 90, 101, 426/122, 123, 115, 130, 95, 106; 229/1.5 B, 43, 87 F; 206/606, 627, 4.5, DIG. 7

[56] References Cited

U.S. PATENT DOCUMENTS

| | | | |
|---|---|---|---|
| 1,153,744 | 9/1915 | Allen | 229/1.5 B |
| 1,375,778 | 4/1921 | Clearwater | 229/1.5 B |
| 1,436,754 | 11/1922 | Chadwick | 426/130 |
| 1,514,379 | 11/1924 | Fleischer | 426/115 |
| 1,599,267 | 9/1926 | Amos | 229/1.5 B |
| 1,672,884 | 6/1921 | Gingras | 229/45 |
| 2,001,919 | 5/1935 | Nolte | 426/123 |
| 2,032,783 | 3/1936 | Wood | 229/1.5 B |
| 2,038,576 | 4/1936 | Krein | 229/1.5 B |
| 2,108,418 | 2/1938 | Thomas | 426/139 |
| 2,125,069 | 7/1938 | Fenner | 426/132 |
| 2,347,161 | 4/1944 | Watts et al. | 426/122 |
| 2,353,582 | 7/1944 | Pearson | 426/132 |
| 2,965,499 | 12/1960 | Wise | 426/139 |
| 2,966,292 | 12/1960 | Saidel | 229/1.5 B |
| 3,039,881 | 6/1962 | Shapiro | 426/132 |
| 3,170,568 | 2/1965 | Carter | 426/139 |
| 3,216,148 | 11/1965 | Amberg | 229/1.5 B |
| 3,246,786 | 4/1966 | Holley | 229/1.5 B |
| 3,487,443 | 12/1969 | Wise et al. | 229/1.5 B |
| 3,624,787 | 11/1971 | Newman | 426/115 |
| 3,967,773 | 7/1976 | Kaufman | 426/130 |

FOREIGN PATENT DOCUMENTS

| | | | |
|---|---|---|---|
| 2164829 | 8/1973 | France | 426/139 |
| 732026 | 6/1955 | United Kingdom | 426/115 |
| 1417125 | 12/1975 | United Kingdom . | |

OTHER PUBLICATIONS

Ice Cream Review 1923, p. 65.

*Primary Examiner*—Steven L. Weinstein
*Attorney, Agent, or Firm*—Birch, Stewart, Kolasch & Birch

[57] ABSTRACT

A serving kit and package for confections includes an unfilled ice cream cone nested in the bottom of a conformally shaped conical jacket which is scored for separation along an annular line located below the rim of the ice cream cone. The upper end of the cone jacket is shaped to receive a snap-on lid, the latter being supplied together with a spoon or other eating utensil to complete the serving kit. Frozen dessert above the cone rim can be eaten with the spoon and then the package can be separated to consume the filled ice cream cone in a conventional manner.

11 Claims, 7 Drawing Figures

FROZEN CONFECTION AND PACKAGING MODULE

This application is a continuation, of copending application Ser. No. 246,180, filed on Mar. 23, 1981, now abandoned.

FIELD OF THE INVENTION

This invention relates to frozen confections and packaging modules for frozen confections such as desserts and the like and, more particularly, to a packaging module comprising a conical paper jacket and an unfilled ice cream cone for receiving additional ingredients and toppings, some internal and some external to the cone but within the jacket and the said jacket being suitable for carrying a lid. The frozen confection product external to the cone but within the jacket is capable of being eaten with a conventional eating utensil such as a spoon or the like. The combined jackets, cones, lids and spoons comprise a serving kit for vendors for the purpose of serving the frozen dessert products of the present invention.

BACKGROUND OF THE INVENTION

It is known to prepackage frozen confections with sundae toppings in jacketed ice cream cones. For example, a paper jacket containing an unfilled ice cream cone and being dimensioned to extend beyond the top edge of the ice cream cone for receiving a greater amount of frozen dessert and sundae topping or the like than can be placed in the cone alone is filled with such frozen dessert and/or toppings in a filling machine and a simple lid or other closure is placed thereon. The entire combination is then prefrozen before shipping to a point of purchase.

Therefore, while such a combination of jacketed cone and frozen dessert has become quite popular, there has heretofore been no similar packaging for a custom-mixed frozen dessert which could be assembled at a point of purchase by a vendor. Furthermore, for products such as soft ice cream or, as known in the trade, soft-serve products, there has been no jacketed cone packaging or serving kit available to compete with the prefrozen jacketed cone products.

It is an object of the present invention to provide a new and novel kit for vendors for assembling and serving frozen confections.

It is another object of the present invention to provide a new and novel frozen dessert package.

Still another object of the present invention is to provide a new and novel package for a frozen confection comprising soft ice cream liquid and semiliquid toppings and the like.

Yet another object of the present invention is to provide a new and novel jacket for unfilled ice cream cones which is suitable for initial consumption of a frozen dessert placed therein by conventional utensils and subsequent consumption of the remainder of that dessert by means of directly consuming the ice cream cone and its contents.

These and other objects of the present invention will become more fully apparent with reference to the following Specification and Drawings which relate to a preferred embodiment of the invention.

SUMMARY OF THE INVENTION

The present invention provides a cone-shaped paper jacket which is substantially longer than a compatibly and conformally shaped conventional ice cream cone, preferably of the sugar-wafer type. Preferably the cone jacket is provided with a rolled upper edge forming an annular bead (top curl). The jacket has an intermediate annular perforation or scoreline to provide for disengaging the upper portion of the cone jacket from the lower portion such as by tearing or the like. The cones are placed in the jackets as a prepackaged element of a vending and serving kit for frozen confections with the scoreline at the intermediate part of the cone jacket being beneath the open rim portion of the ice cream cone.

A snap-on lid is provided for ultimate engagement with the top curl of the paper cone jacket to form a closed container in the identical manner as the lid would attach to the top curl of a paper cup of like diameter. The lids may be relatively flat or domed, such as a hemispherical or frustoconical configuration or other desired shape.

Also packaged with the lids and prepackaged unfilled ice cream cones are a like number of spoons or other conventional eating utensils to complete a kit for serving frozen confections and desserts, particularly for soft ice cream and similar products at the point of purchase thereof.

In use, the prepackaged cones are filled to a given level above the rim of the cone and well up into the jacket toward the top curl thereof with a soft ice cream or other frozen or semifrozen dessert product and then, the remaining space is filled with the type of sundae toppings or other garnishes desired. Of course, the entire paper jacket and cone may be filled with a semifrozen confection substance up to a point immediately beneath the top curl thereof.

At this point a lid is snapped into place on the top curl of the paper jacket and the frozen confection and package module is complete with the exception of the eating utensil which is concurrently provided from the serving kit.

To consume the frozen dessert, the lid is removed from the top curl of the paper jacket and the eating utensil, such as a spoon, is utilized to consume the sundae topping and a substantial portion of the frozen dessert substance which is located above the upper open rim of the now filled ice cream cone within the jacket.

At the time the ice cream cone becomes visible to the consumer of the frozen dessert, at the option of the consumer, the jacket may be torn away from the cone by physically tearing it along the score line or perforation line to expose part of the side wall and the upper rim portion of the filled ice cream cone for consumption in the normal mode of eating an ice cream cone filled with ice cream or the like, that normal mode being by direct ingestion without utensils.

DETAILED DESCRIPTION OF THE DRAWINGS

Figure 2:
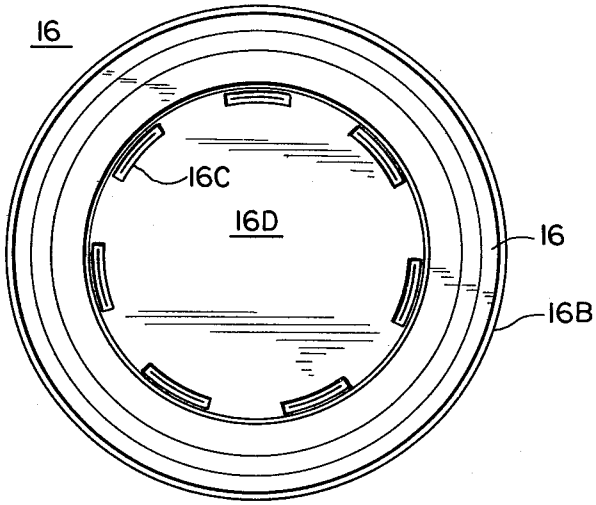
FIG. 2 is a top plan view of the lid used in FIG. 1 of the present invention.
Figure 1:
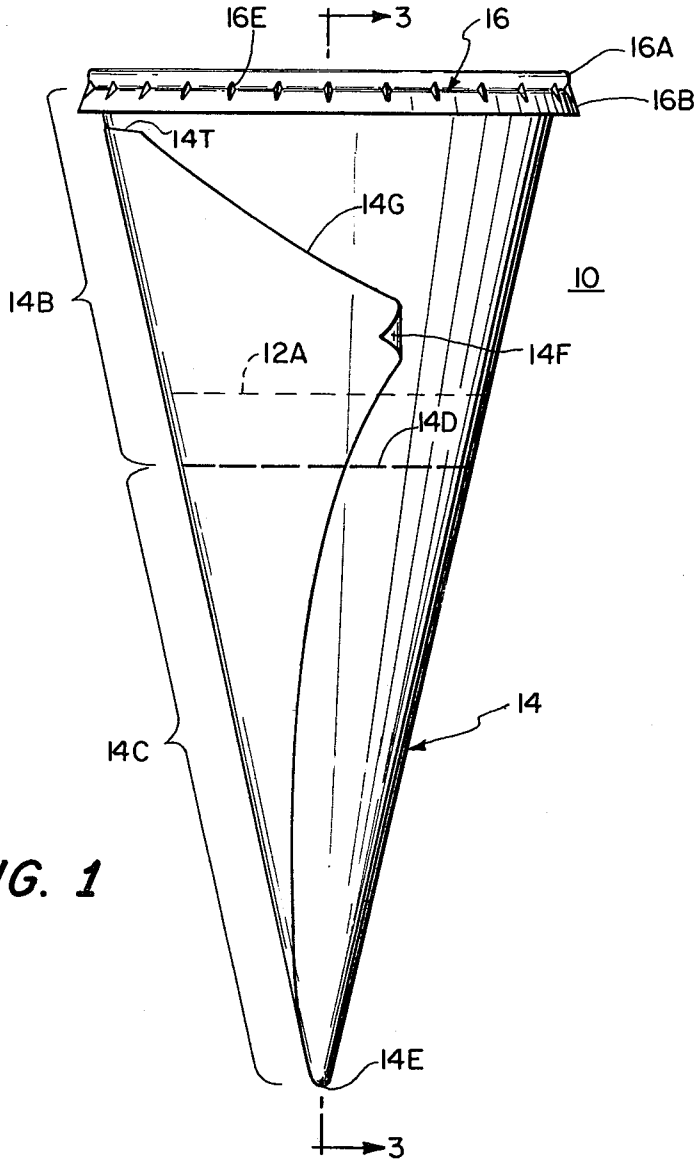
FIG. 1 is a side elevation of an assembled ice cream cone, ice cream cone jacket and lid of the present invention.
Figure 3:
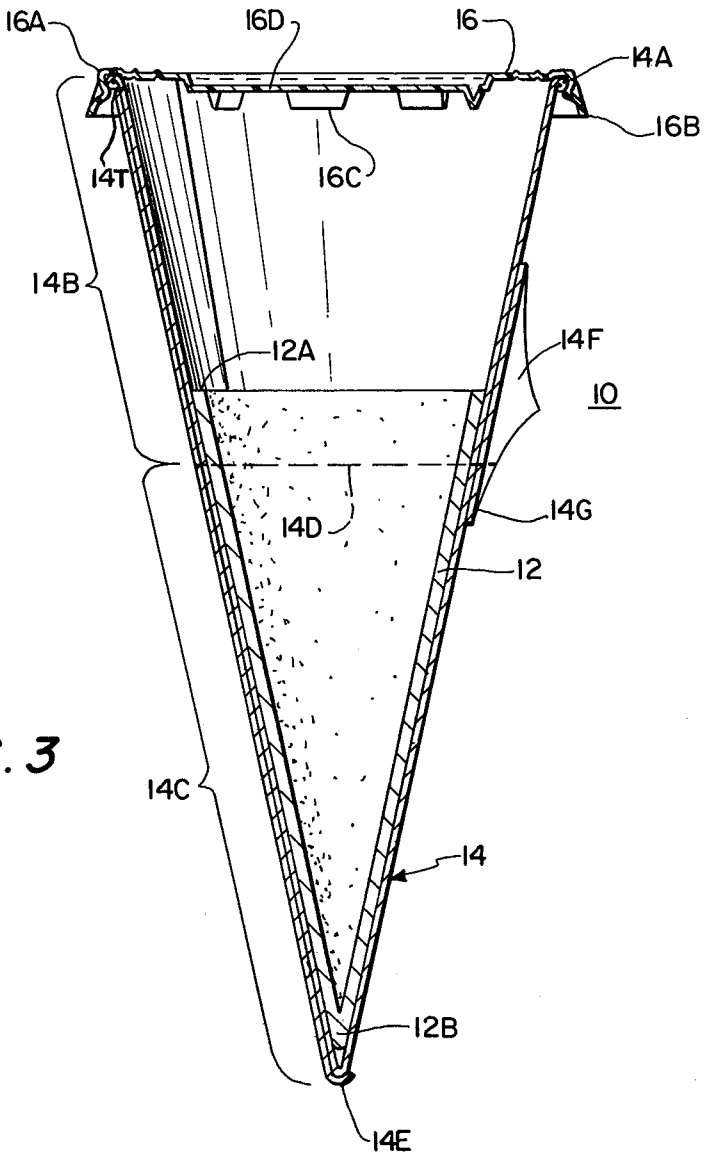
FIG. 3 is a cross-section taken along line 3—3 of FIG. 1.

Referring in detail to the drawings and with particular reference to FIGS. 1, 2, and 3, the frozen confection package 10 of the present invention is shown as including an unfilled ice cream cone 12 nested in an elongated conical paper jacket 14 conformally shaped to receive the cone 12 in the lowermost portion thereof and a snap-on lid 16 engaged with a top curl portion 14A at the uppermost open end of the paper jacket 14. The paper jacket 14 is divided into a tear-away upper section 14B and a residual lower section 14C separated by an annular scoreline or perforation line 14D surrounding the ice cream cone 12 at a point substantially below the uppermost open edge or rim 12A thereof. The closed apex 12B of the ice cream cone 12 is tightly nested in the closed apex 14E of the paper jacket 14.

The cone jacket 14 is preferably of a wound paper blank configuration having an internal seam line (not shown) and an external tear tab 14F extending freely from a glued laminated portion 14G which acts to hold the wound paper blank in its conical configuration. Glued portion 14G prevents relative movement of the overlapped portion of the jacket in upper jacket portion 14B, preventing separation of the overlapped jacket portions and preventing escape of the contents of upper portion 14B through the seam formed by the overlapped jacket portions as would otherwise occur. Additionally, prevention of relative movement of the overlapped jacket portions in upper portion 14B enhances the structural integrity of the jacket, imparting a degree of rigidity and maintaining the original configuration of the jacket. Thus, upper jacket portion 14B can readily serve as a bowl-like structure while the confection is eaten therefrom with a utensil.

In addition to receiving lid 16, annular bead or curl 14A serves to further enhance the rigidity and usefulness of upper portion 14B. As shown in FIGS. 1, 3 and 5–7, uppermost portion 14T of the outer overlapped wrapper portion does not extend into annular bead or curl 14A. As shown in FIG. 3, which is a cross section along line 3—3 of FIG. 1, at a position in the wrapper approximately 180° from portion 14F, uppermost portion 14T of the outer overlapped wrapper portion is adjacent to, but does not extend into the annular bead.

The snap-on lid 16 is illustrated as including a rim receiving annular portion 16A and a dependent snap-on skirt portion 16B which engages beneath the top curl 14A of the cone jacket 14 to maintain the lid 16 in place thereon. The lid 16 is further provided with variably located stacking lugs 16C in a central web portion 16D thereof and stiffening flutes 16E for the dependent skirt portion 16B to insure a good gripping action of the lid on the top curl 14A. These features of the lid 16 are generally known in the art.

Figure 4:
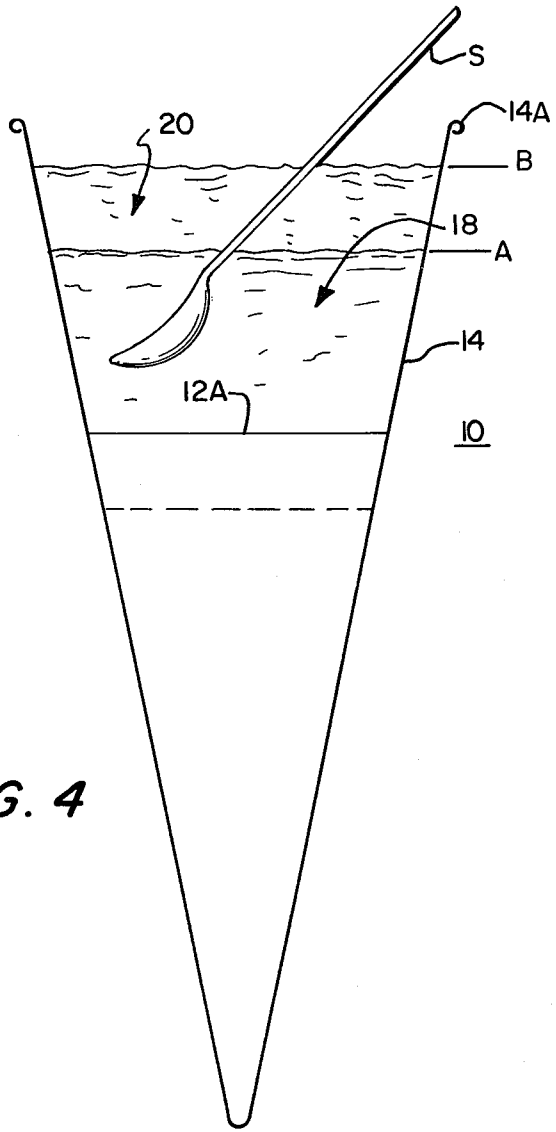
FIG. 4 is a schematic diagram illustrating the relative levels of frozen confection, topping and the like with respect to the ice cream cone and jacket illustrated in FIG. 3.

With reference now to FIG. 4, a schematic illustration is provided in which the jacket 14 and cone 12 have been filled to a level A with a frozen confection product 18 such as soft ice cream or the like. Between the level A, which is well above the rim 12A of the ice cream cone 12 and a level B immediately beneath the top curl 14A of the cone jacket 14, is provided another confection or dessert substance 20 such as sundae topping, nuts, fruit, etc. Sundae toppings are often a sauce, syrup or the like. However, since separation of the overlapped jacket portions is prevented in upper portion 14B by glued portion 14G, such toppings will not escape from between the overlapped jacket portions.

Once this filling of the ice cream cone 12 and its paper jacket 14 have been completed, the lid 16 may be placed thereon to complete the container 10, (now complete with contents) in the manner shown in FIGS. 1 and 3.

In order to consume this frozen confection, the consumer need only remove the lid 16 to place the package 10 in the general condition illustrated in the schematic of FIG. 4 and utilize a spoon S or other conventional serving utensil to eat the sundae topping 20 and the frozen confection 18 down to a level proximate to the upper rim 12A of the ice cream cone 12.

Because upper portion 14B is glued at portion 14G, forming a frustoconical wall, portion 14B has sufficient strength and rigidity to function as a bowl-like structure, much as a conventional ice cream cup.

Figure 5:
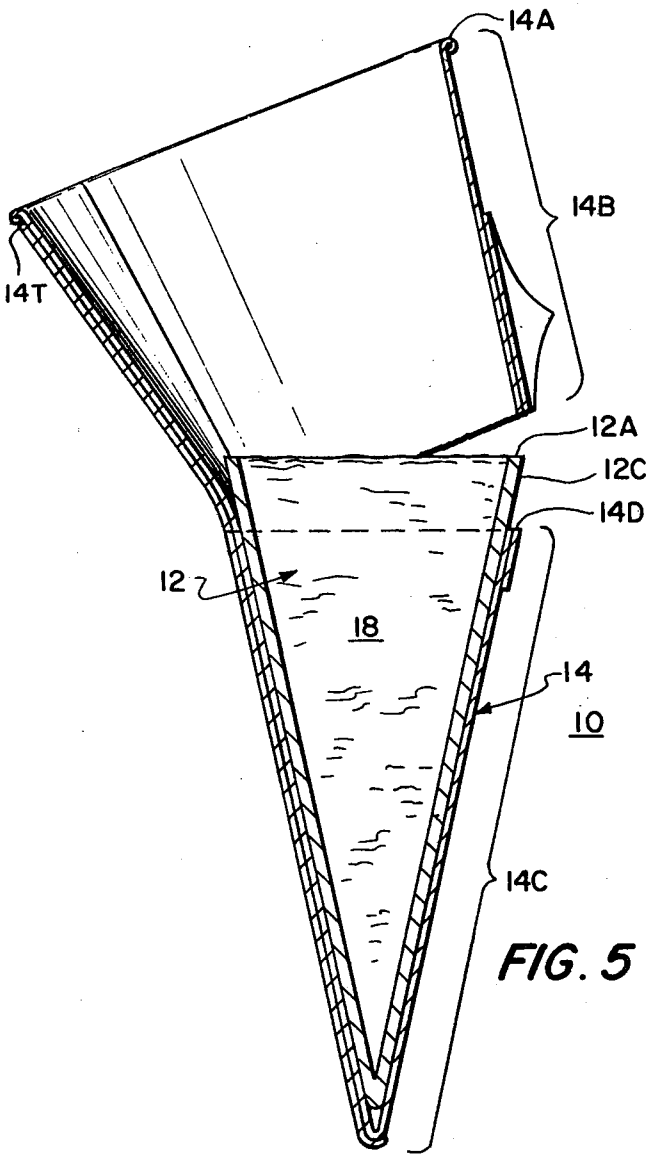
FIG. 5 is a cross-section illustrating the tearing away of the upper portion of the ice cream cone jacket of the present invention during the use thereof.

Referring now to FIG. 5, at this point in time of the consumption of the frozen dessert product, the upper section 14B may be detached from the lower section 14C of the ice cream cone jacket 14 along the annular scoreline 14D by means of the tear tab 14F to expose the upper rim 12A and a portion of the side wall 12C of the ice cream cone 12 so that the cone 12 and the remaining contents 18 therein can be consumed in the conventional manner of eating an ice cream cone by direct ingestion.

Figure 7:
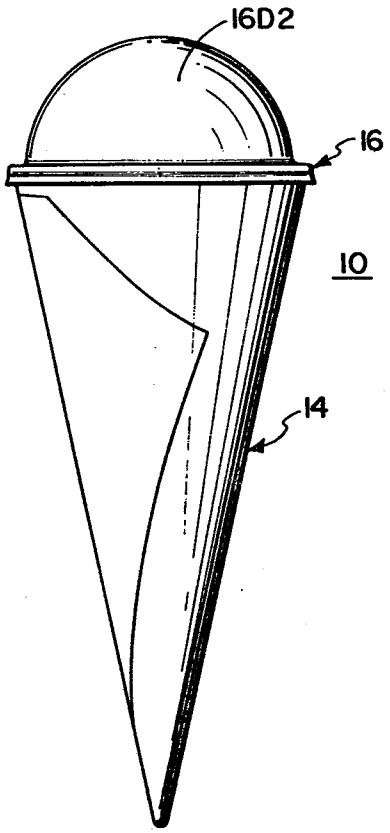
FIG. 7 is a side elevation of a frozen confection module having a substantially hemispherical domed lid.
Figure 6:
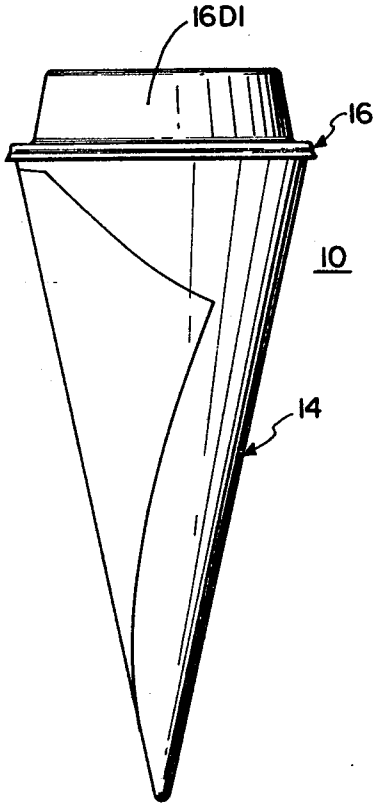
FIG. 6 is a side elevation of a frozen confection module having a frustoconical domed lid.

As alternate prefered embodiments of the present invention, domed configurations of the lid 16 on the jacket 14 of the module 10 may be provided, as shown in FIGS. 6 and 7. In FIG. 6, the lid 16 has a frustoconical domed central portion 16D1 while in FIG. 7, the lid 16 has a substantially hemispherical domed central portion 16D2.

While reference is made to a paper cone jacket throughout the Specification, any suitable jacketing material which can function in the manner intended for the jacket 14 can be substituted for paper in the present invention.

As can be seen from the foregoing Specification and Drawings, the present invention provides a new and novel point of purchase assembly and serving package and kit for frozen confections, desserts and the like and is particularly well adapted for soft-serve or soft-frozen ice cream products and the like including toppings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Receptacle means for receiving a confection comprising:

an unfilled ice cream cone having open and closed ends; and conical wrapper means having open and closed ends and nestably receiving said ice cream cone in the closed end thereof, said wrapper means comprising:

overlapped wrapper portions extending generally from said open end to said closed end of said wrapper and comprising a first wrapper portion overlapped on the exterior of a second wrapper portion;

upper and lower separable sections joined together below said open end of said ice cream cone, said lower section having a conical configuration and said upper section having a frustoconical configuration;

separation means responsive to tearing force for separating said upper section from said lower section and from said ice cream cone for exposing at least a portion of said ice cream cone;

said upper section extending substantially beyond said open end of said ice cream cone;

means for bonding said first and second overlapped wrapper portions together in said upper section for preventing relative movement of said overlapped wrapper portions, for preventing escape of the confection from between said overlapped wrapper portions in said upper section, and for maintaining said frustoconical configuration of said upper section for facilitating consumption of the confection from said upper section by means of a utensil; and annular bead means comprising a curled portion of said conical wrapper at the open end thereof for enhancing the rigidity of said upper section and for maintaining said frustoconical configuration thereof during consumption of the confection by means of a utensil, wherein substantially the entire uppermost edge portion of said first overlapped wrapper portion adjacent said open end does not extend into said annular bead means.

2. The receptacle means of claim 1, further comprising lid means for closing said open end of said wrapper means.

3. The receptacle means of claim 2, wherein said lid means is selectively engageable with said annular bead means.

4. The receptacle of claim 2, wherein said lid means is dome shaped.

5. The receptacle of claim 1, further comprising tear tab means extending from said wrapper means for applying tearing force for separating said upper and lower sections.

6. A receptacle means as in claim 1, in combination with:

a confection substantially filling both said ice cream cone and said upper and lower sections of said wrapper means.

7. The combination of claim 6, further comprising utensil means associated with said receptacle for forming a kit and for facilitating consumption of said confection from said upper section of said wrapper means prior to separation of said upper and lower sections of said wrapper means.

8. The combination of claim 6, further comprising tear tab means extending from said wrapper means for applying tearing force for separating said upper and lower sections.

9. A combination as in claim 6, wherein said confection comprises toppings within said upper section of said wrapper means.

10. The combination of claim 6, further comprising lid means selectively engageable with said annular bead means for closing said open end of said wrapper means.

11. The combination of claim 10, wherein said lid means is dome shaped.

* * * * *